US007823728B2

(12) United States Patent
Baltz

(10) Patent No.: US 7,823,728 B2
(45) Date of Patent: Nov. 2, 2010

(54) STORAGE CONTAINER WITH SUPPORT STRUCTURE FOR MULTIPLE LEVELS OF NESTING

(75) Inventor: Kyle L. Baltz, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 1081 days.

(21) Appl. No.: 11/073,336

(22) Filed: Mar. 4, 2005

(65) Prior Publication Data

US 2006/0196800 A1 Sep. 7, 2006

(51) Int. Cl.
*B65D 21/032* (2006.01)

(52) U.S. Cl. ..... 206/506

(58) Field of Classification Search ..... 206/506, 206/507

See application file for complete search history.

(56) References Cited

U.S. PATENT DOCUMENTS

| | | | | |
|---|---|---|---|---|
| 189,378 | A | | 4/1877 | Niedringhaus et al. |
| 1,082,274 | A | | 12/1913 | Lapish |
| 1,219,969 | A | | 3/1917 | Lowe |
| 1,308,036 | A | * | 7/1919 | Boyd ..... 206/506 |
| 1,378,614 | A | | 5/1921 | McLeod et al. |
| 2,029,746 | A | | 2/1936 | Tufts et al. |
| 2,061,414 | A | | 11/1936 | Tufts et al. |
| 2,134,875 | A | | 11/1938 | Henze |
| 2,221,504 | A | | 11/1940 | Beasley et al. |
| 2,512,522 | A | | 6/1950 | Denny |
| 2,553,607 | A | | 5/1951 | Rosenberg |
| 2,609,120 | A | | 9/1952 | Williams |
| 2,747,748 | A | | 5/1956 | Barefoot |
| 2,777,627 | A | | 1/1957 | Crane |
| 2,782,950 | A | | 2/1957 | Corr |
| 2,850,204 | A | | 9/1958 | Rehrig |
| RE25,050 | E | | 10/1961 | Hamilton |
| 3,186,585 | A | | 6/1965 | Denny |
| 3,220,603 | A | | 11/1965 | Bromley |
| 3,323,673 | A | | 6/1967 | Cowan |
| 3,360,180 | A | | 12/1967 | Venturi |
| 3,374,915 | A | | 3/1968 | Verhein et al. |

(Continued)

FOREIGN PATENT DOCUMENTS

| | | |
|---|---|---|
| CA | 2 069 226 | 4/2003 |

(Continued)

OTHER PUBLICATIONS

International Search Report for PCT/US2005/012473, Oct. 31, 2005.

(Continued)

*Primary Examiner*—Stephen Castellano
(74) *Attorney, Agent, or Firm*—Carlson, Gaskey & Olds

(57) ABSTRACT

A storage container includes a base and a plurality of walls extending upwardly from the base. At least one of the walls includes a plurality of projections on its exterior at different heights. The interior of the wall includes a plurality of channels into which the projections of a like container would be slidably received when the empty containers are nested. A plurality of supports are pivotably connected to the container and can be selectably pivoted to block selected ones of the plurality of channels such that the projections are supported on the supports and do not enter the channels, thereby supporting the upper container at a selected height.

34 Claims, 13 Drawing Sheets

U.S. PATENT DOCUMENTS

| | | | | |
|---|---|---|---|---|
| 3,379,339 | A * | 4/1968 | Asenbauer | 206/506 |
| 3,685,718 | A | 8/1972 | Chidgey | |
| 3,840,115 | A | 10/1974 | Ladewig | |
| 3,940,018 | A | 2/1976 | Schoeller | |
| 3,951,265 | A | 4/1976 | Carroll | |
| 3,982,650 | A | 9/1976 | Ichihara | |
| 4,049,113 | A | 9/1977 | Joyce et al. | |
| 4,090,633 | A | 5/1978 | Trubiano | |
| 4,106,623 | A | 8/1978 | Carroll | |
| 4,109,791 | A | 8/1978 | Clipson et al. | |
| 4,214,669 | A | 7/1980 | McQuiston | |
| 4,241,831 | A | 12/1980 | Locatelli | |
| 4,247,004 | A | 1/1981 | Bird | |
| 4,293,069 | A | 10/1981 | Partain | |
| 4,391,369 | A | 7/1983 | Stahl et al. | |
| 4,423,813 | A | 1/1984 | Kreeger et al. | |
| 4,466,541 | A | 8/1984 | Tabler et al. | |
| 4,505,422 | A | 3/1985 | Vossen | |
| 4,508,237 | A | 4/1985 | Kreeger et al. | |
| 4,573,577 | A | 3/1986 | Miller | |
| 4,579,220 | A | 4/1986 | Brundage | |
| RE32,223 | E | 8/1986 | Kreeger et al. | |
| 4,624,381 | A | 11/1986 | Friedrich | |
| 4,643,310 | A | 2/1987 | Deaton et al. | |
| 4,735,331 | A | 4/1988 | Keenan et al. | |
| 4,759,451 | A | 7/1988 | Apps | |
| 4,770,300 | A | 9/1988 | Klein | |
| 4,773,533 | A * | 9/1988 | Greene | 206/288 |
| 4,848,578 | A | 7/1989 | Schafer | |
| 4,863,062 | A | 9/1989 | Holliday | |
| 4,905,833 | A | 3/1990 | Kreeger et al. | |
| 4,946,093 | A | 8/1990 | Moorman | |
| 4,947,992 | A | 8/1990 | Schafer | |
| 4,982,844 | A | 1/1991 | Madan et al. | |
| 5,083,666 | A | 1/1992 | Lam | |
| 5,415,293 | A | 5/1995 | Ackermann | |
| 5,445,425 | A | 8/1995 | Lyver | |
| 5,469,986 | A | 11/1995 | Jang | |
| 5,494,163 | A | 2/1996 | Apps | |
| 5,609,254 | A | 3/1997 | Loftus et al. | |
| 5,617,953 | A | 4/1997 | Cope | |
| D381,203 | S | 7/1997 | Ackermann | |
| D382,404 | S | 8/1997 | Cope | |
| 5,752,602 | A | 5/1998 | Ackermann | |
| 5,772,033 | A | 6/1998 | Loftus et al. | |
| 5,881,902 | A | 3/1999 | Ackermann | |
| 5,924,572 | A | 7/1999 | Cope | |
| 6,059,114 | A | 5/2000 | Loftus | |
| D436,729 | S | 1/2001 | Aiken | |
| 6,938,772 | B2 | 9/2005 | Aiken et al. | |
| 7,014,043 | B2 | 3/2006 | Raghunathan et al. | |
| 7,017,745 | B2 | 3/2006 | Raghunathan | |
| 2002/0117420 | A1 | 8/2002 | McDade | |
| 2002/0179480 | A1 | 12/2002 | Raghunathan et al. | |
| 2003/0155366 | A1 | 8/2003 | Raghunathan | |
| 2003/0222081 | A1 | 12/2003 | Apps et al. | |
| 2003/0230510 | A1 | 12/2003 | Aiken et al. | |
| 2004/0245142 | A1 | 12/2004 | Raghunathan | |
| 2005/0224385 | A1 | 10/2005 | Hassell et al. | |
| 2005/0263423 | A1 | 12/2005 | Hassell et al. | |
| 2005/0263424 | A1 | 12/2005 | Hassell et al. | |
| 2006/0065567 | A1 | 3/2006 | Hassell et al. | |
| 2006/0108372 | A1 | 5/2006 | Aiken et al. | |
| 2006/0194190 | A1 * | 8/2006 | Riley et al. | 434/365 |
| 2006/0231449 | A1 | 10/2006 | Hassell et al. | |

FOREIGN PATENT DOCUMENTS

| | | |
|---|---|---|
| DE | 83 03 842.6 | 1/1984 |
| DE | 35 11 321 | 10/1986 |
| DE | 35 21 894 | 1/1987 |
| DE | 35 40 005 | 1/1987 |
| DE | 41 02 082 | 7/1992 |
| DE | 295 01 696.5 | 4/1995 |
| DE | 195 06 228 | 9/1995 |
| DE | 199 39 019 | 1/2001 |
| DE | 200 02 537 | 7/2001 |
| EP | 299657 | 1/1989 |
| EP | 0 311 174 | 4/1989 |
| EP | 0 413 884 | 1/1990 |
| EP | 0 368 713 | 5/1990 |
| EP | 508461 | 10/1992 |
| EP | 0 557 002 | 8/1993 |
| EP | 786413 | 1/1996 |
| EP | 0 697 341 | 2/1996 |
| EP | 0 751 074 | 1/1997 |
| EP | 0 856 469 | 8/1998 |
| EP | 0 953 509 | 3/1999 |
| EP | 0 926 073 | 6/1999 |
| EP | 1 170 223 | 1/2002 |
| EP | 0 841 254 | 9/2002 |
| EP | 1241105 | 9/2002 |
| EP | 0 818 394 | 1/2003 |
| EP | 1 150 901 | 5/2003 |
| EP | 1 025 011 | 4/2004 |
| EP | 0 932 560 | 1/2005 |
| EP | 1 261 937 | 1/2005 |
| EP | 1 609 725 | 3/2007 |
| EP | 1 785 360 | 5/2007 |
| ES | 2115462 | 8/1994 |
| FR | 1 040 163 | 10/1953 |
| FR | 2 325 565 | 9/1975 |
| FR | 2 627 746 | 2/1988 |
| FR | 2 678 585 | 1/1993 |
| FR | 2 701 690 | 2/1993 |
| FR | 2829111 | 9/2001 |
| FR | 2 864 034 | 11/2008 |
| GB | 916356 | 4/1961 |
| GB | 947404 | 1/1964 |
| GB | 1 335 729 | 10/1973 |
| GB | 2 068 338 | 8/1981 |
| GB | 2090227 | 7/1982 |
| GB | 2 214 588 | 2/1984 |
| GB | 2 129 401 | 5/1984 |
| GB | 2 137 167 | 10/1984 |
| GB | 2 141 778 | 1/1985 |
| GB | 2 171 980 | 9/1986 |
| GB | 2 174 678 | 11/1986 |
| GB | 2 180 821 | 4/1987 |
| GB | 2 209 737 | 5/1989 |
| GB | 2223481 | 11/1990 |
| GB | 2 255 076 | 10/1992 |
| GB | 2 257 422 | 1/1993 |
| GB | 2 245 251 | 2/1994 |
| GB | 2 296 009 | 6/1996 |
| GB | 2 283 728 | 7/1997 |
| GB | 2 287 241 | 9/1997 |
| GB | 2 330 826 | 5/1999 |
| GB | 2 333 285 | 7/1999 |
| GB | 2 313 361 | 12/1999 |
| GB | 2 340 485 | 8/2000 |
| GB | 2 350 350 | 11/2000 |
| GB | 2 340 482 | 6/2001 |
| GB | 2 330 131 | 11/2001 |
| GB | 2 373 239 | 9/2002 |
| GB | 2 373 240 | 9/2002 |
| GB | 2 374 859 | 10/2002 |
| GB | 2 345 053 | 1/2003 |
| GB | 2 359 066 | 7/2003 |
| GB | 2 425 302 | 10/2006 |
| GB | 2427606 | 1/2007 |
| GB | 2 431 917 | 5/2007 |
| GB | 2 431 921 | 5/2007 |
| GB | 2 431 922 | 5/2007 |

| | | |
|---|---|---|
| JP | 10-86930 | 7/1998 |
| JP | 2000-355323 | 12/2000 |
| MX | 01001201 | 8/2002 |
| NL | 790 5105 | 6/1979 |
| NL | 9002518 | 6/1992 |
| SE | 210 889 | 2/1967 |
| SU | 171783 | 3/1966 |
| SU | 1518216 | 10/1989 |
| TW | 338405 | 8/1998 |
| TW | 372539 | 10/1999 |
| WO | 93/24378 | 12/1993 |
| WO | 98/01352 | 1/1998 |
| WO | 00/27716 | 5/2000 |
| WO | 00/51900 | 9/2000 |
| WO | 00/66440 | 11/2000 |
| WO | 03/104094 | 12/2003 |
| WO | 2005/100179 | 10/2005 |
| WO | 2005/115854 | 12/2005 |
| WO | 2006/036868 | 4/2006 |

OTHER PUBLICATIONS

International Search Report for PCT/US2005/018374, Aug. 24, 2005.
International Search Report for PCT/US2005/034355, Feb. 13, 2006.
United Kingdom Search Report for 0607419.9, Jun. 27, 2006.
United Kingdom Search Report, Jul. 4, 2006.
United Kingdom Search Report for UK Application No. GB0814508.8, Sep. 22, 2008.

* cited by examiner

STORAGE CONTAINER WITH SUPPORT STRUCTURE FOR MULTIPLE LEVELS OF NESTING

BACKGROUND OF THE INVENTION

Portable storage containers that both stack and nest with similar containers are commonly used in industry for transporting and storing goods. Nesting is typically achieved with an empty container receives a like container therein such that there is overlap between the walls and container. On the other hand, the stacking feature is typically used when an occupied container has a like container supported thereon, such that there is relatively little or no overlap between the walls of the container, and the goods contained in the lower container are preferably not contacted or damaged by the upper container.

Many containers include bail members to achieve this stacking feature. Bail members are typically slidably and pivotally connected to opposite walls. The bail members can be positioned out of the way for purposes of nesting, and can be moved to one or more stacking positions (i.e., vertically aligned with the floor) to permit another container to be stacked thereon.

SUMMARY OF THE INVENTION

A storage container according to the present invention includes a base, a pair of opposed end walls extending upwardly from the base and a pair of opposed side walls extending upwardly from the base. A support system is mounted proximate each end wall. Each support system includes a plurality of supports pivotably connected to the end wall. Each end wall further includes a plurality of projections from the exterior of the end wall. The projections are formed at different heights from the base in pairs. For example, in the embodiment described, there are three pair of projections on each end wall, the two projections within each pair are at the same height and each pair of projections is at a different height. Each projection forms corresponding vertically-extending channel on the interior of the end wall, such that the projections of one container would be aligned and would be slidably received within the channels of a similar container into which it is nested.

When pivoted inwardly to a support position, each of the supports selectably blocks one pair of the channels such that the projections of the upper container would not be received within the blocked channel, but would be supported upon the support. By selectively blocking different channels, and thereby providing support to projections of different heights, the upper container is supported at varying heights relative to the base of the lower container.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
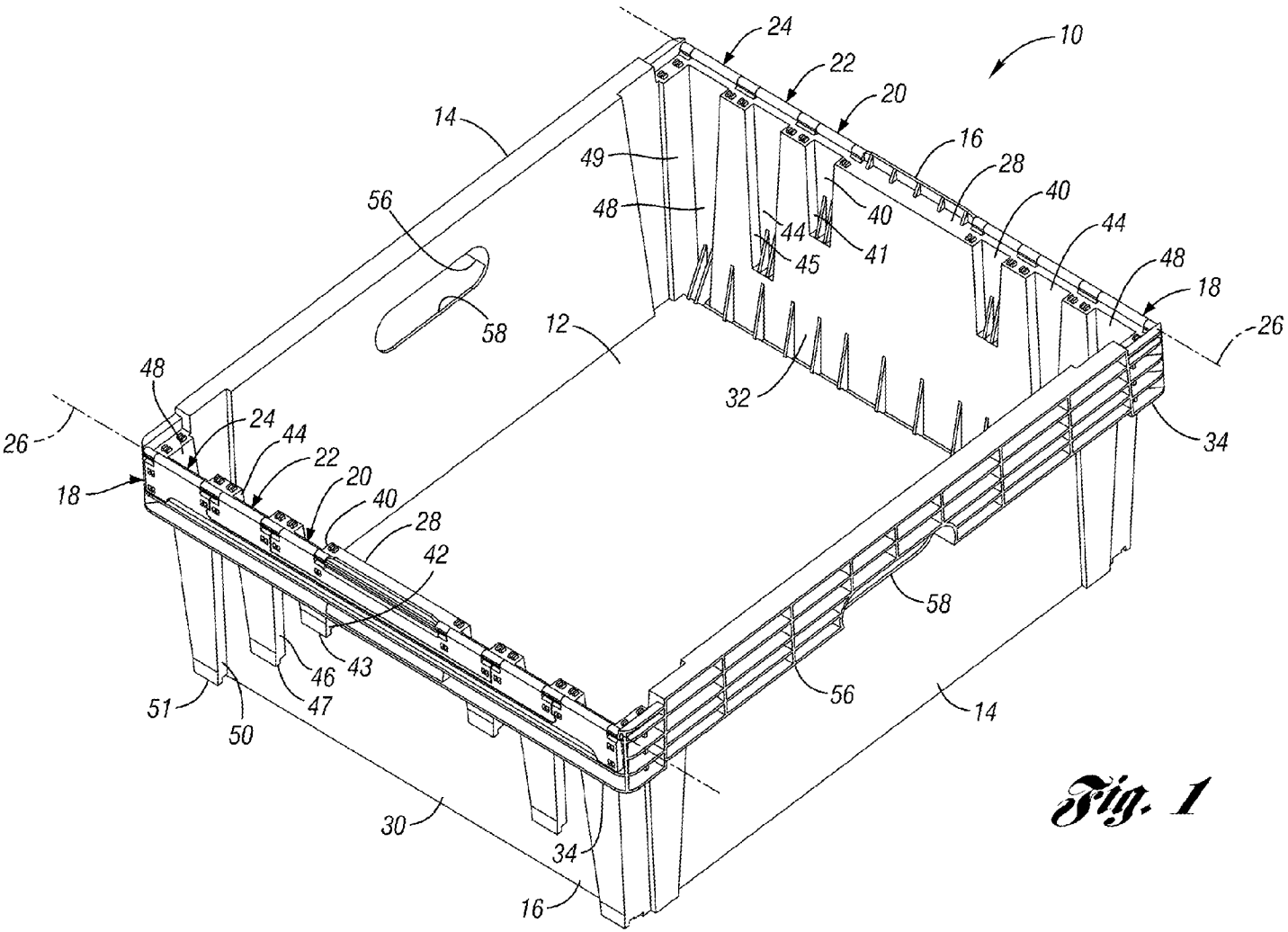
FIG. 1 is a perspective view of the storage container with the supports in the open, nesting position.

A storage container 10 according to the present invention is shown in FIG. 1. The storage container 10 generally includes a floor or base 12, a pair of side walls 14 and a pair of end walls 16 extending upwardly from a periphery of the base 12. A support system 18 is mounted to the container 10 proximate each end wall 16. In the embodiment shown, the support system 18 is mounted to an upper edge of the end wall 16. The support system 18 includes a first support 20 hingeably mounted to the end wall 16. A second support 22 and a third support 24 are each hingeably mounted to the end wall 16. The first, second and third supports 20, 22 and 24 are each independently pivotable relative to one another and relative to the end wall 16 about a common axis 26 adjacent an outer edge of an upper surface 28 of the end wall 16.

Each end wall 16 includes an exterior surface 30 and an interior surface 32. A horizontal lip or flange 34 protrudes outwardly from the exterior 30 of each end wall 16. The interior 32 of each end wall 16 includes a pair of vertically extending first channels 40 a pair of vertically extending second channels 44 outward of the first channels 40 and a pair of vertically extending third channels 48 outward of the second channels 44. The channels 40, 44, 48 open upwardly and inwardly. The channels 40, 44, 48 define alternate first, second and third columns 41, 45, 49 that extend to the upper surface 28 of the end wall 16. Each channel 40, 44, 48 also forms a corresponding first, second and third projection 42, 46, 50, respectively, on the exterior surface 30 of the end wall 16. A lower end of each projection 42, 46, 50 forms an interlocking member 43, 47, 51, respectively. The lower ends of the first projections 42 are at a first height above a plane containing the base 12. The lower ends of the second projections 44 are at a second height relative to the base 12, the second height being less than the first height. The lower ends of the third projections 48 are at a third height relative to the base 12, the third height less than the second height. Each side wall 14 also includes a horizontal lip or flange 56 and further includes an opening to form a handle 58.

Figure 2:
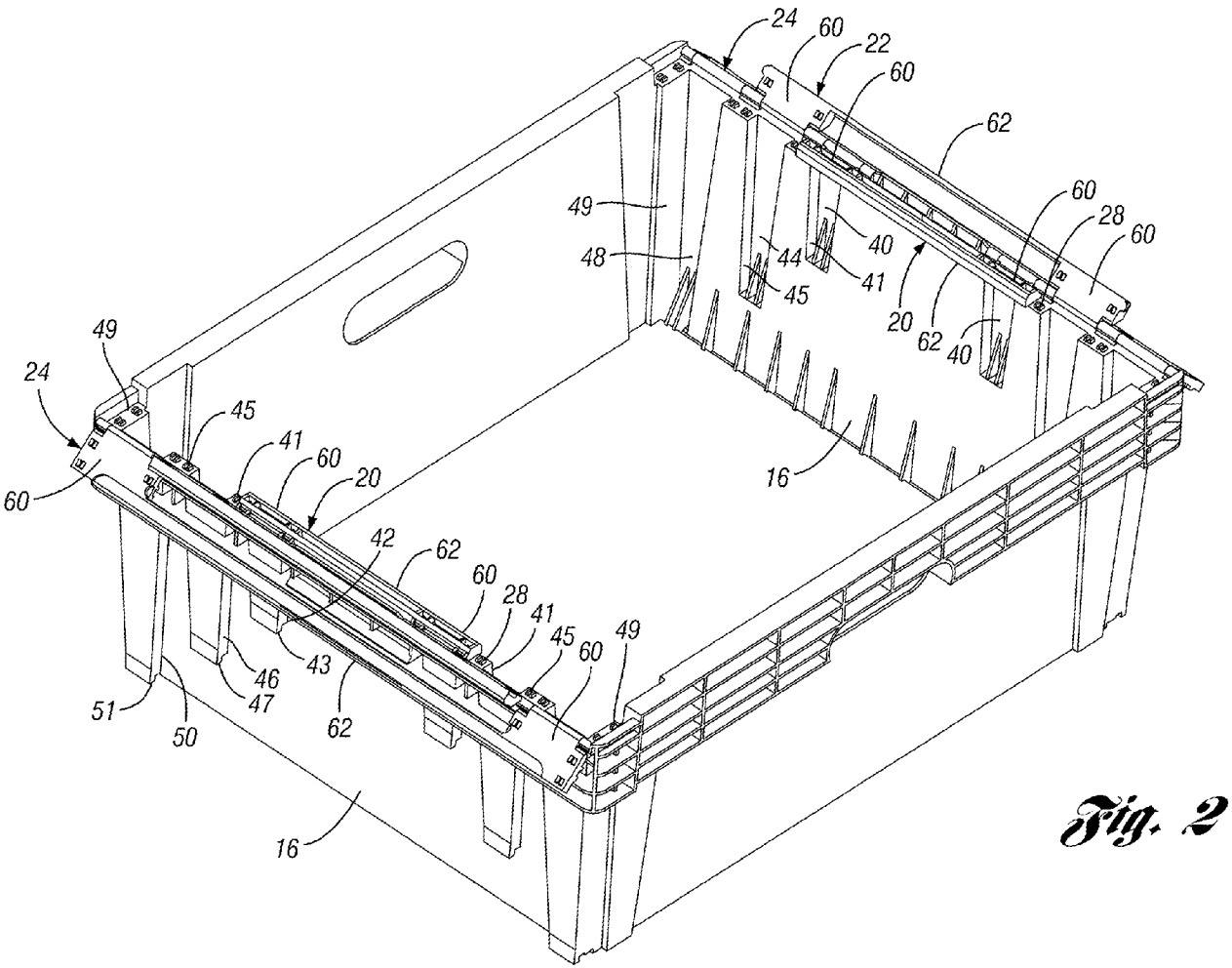
FIG. 2 is a perspective view of the storage container of FIG. 1 with the first support in the stacking position and the second support and the third support pivoted upwardly for illustration.

As can be seen in FIG. 2, the first, second and third supports, 20, 22, 24 are each pivotable relative to the container. Each support 20, 22, 24 includes a pair of flaps 60 hingeably connected to the end wall 16 and connected to one another by a beam 62. In FIG. 2, the first supports 20 have been pivoted to a stack position. In the stack position, the flaps 60 cover and block the first channels 40 while being supported on the first columns 41 and the upper surface 28 of end wall 16. Similarly, the second support 22 can be pivoted to a stacked position in which the flaps 60 would cover and block the second channels 44 and be supported on the first and second columns 41, 45. Similarly, a third support 24 can be pivoted to the stacked position where the flaps 60 would rest on the second and third columns 45, 49 and hover and block the third channels 48.

Figure 3:
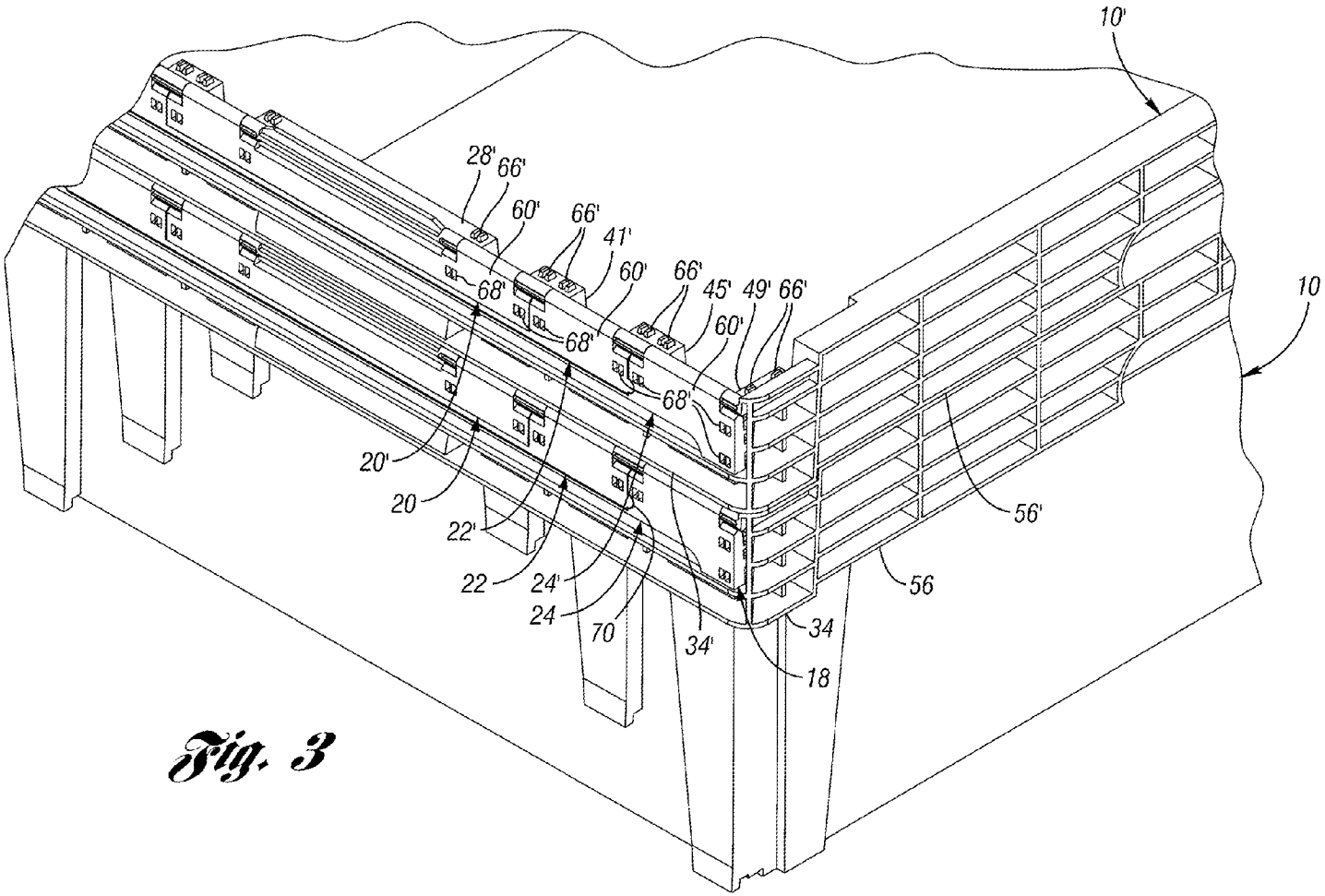
FIG. 3 is a perspective view of one corner of the storage container of FIG. 1 in the nesting position with a similar container nested therein.

FIG. 3 illustrates the storage container 10 with the support system 18, including the first support 20, second support 22 and third support 24, in the open or nest position and with a like storage container 10' nested therein. The upper container 10' and lower container 10 are identical and corresponding components on the upper container 10' will be indicated with identical reference numerals appended with a prime designation. Thus, descriptions of any components on the upper container 10' apply equally to the lower container 10 and vice versa. In this position, the empty containers 10, 10' can be stored or shipped while occupying the least amount of space. Other similar containers can be nested within the upper container 10' and so on.

While nested, the flange 56' of the upper container 10' is supported on the flange 56 of the lower container 10 and the flange 34' of the upper container 10' is supported on the flange 34 of the lower container 10. As can be seen more clearly in FIG. 3, the upper surfaces of the columns 41', 45' and 49' each include a plurality of tenons 66' which are positioned to be received in mortises 68' on the flaps 60' of the first, second and third supports 20', 22', 24'.

Figure 4:
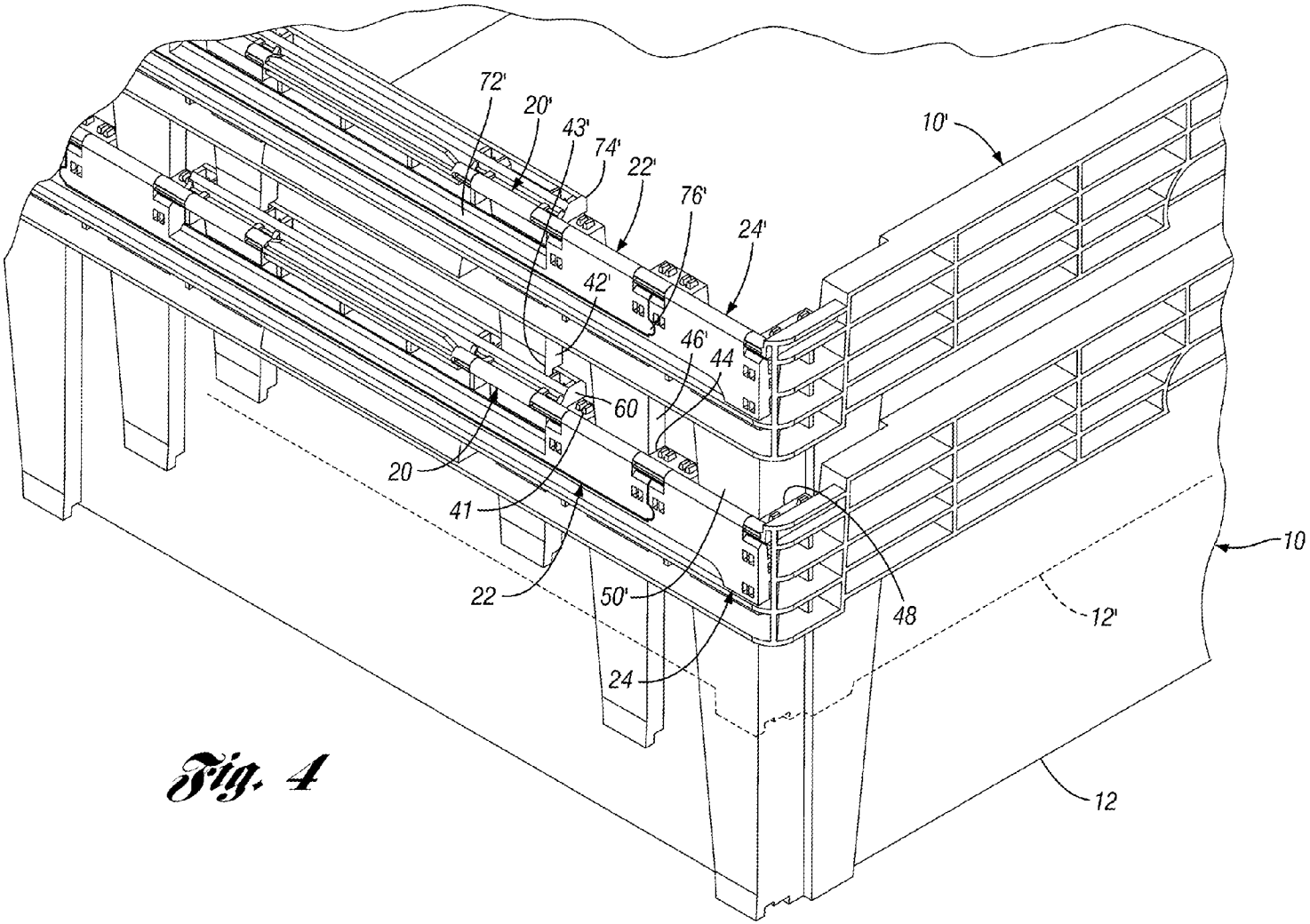
FIG. 4 is a perspective view of the containers of FIG. 3 in a first stacked position.

In FIG. 4, the first supports 20, 20' of the lower and upper containers 10, 10' have been pivoted to the stacked position in which the flaps 60, 60' cover the first channels 40, 40' (FIG. 1). In this first stack position, the flap 60 of the lower container 10 thus prevents the first projection 42' of the upper container 10' from entering the first channel 40. The first projection 42' is supported on the flap 60 on the first support 20. The second and third projections 46', 50' of the upper container 10' are partially received within the second and third channels 44, 48 of the lower container 10 respectively. The base 12' of the upper container 10' is supported at a first distance above the base 12 of the lower container 10. The interlocking member 43' of the first support 42' is received within a recess in the flap 60 of the first support 20. Referring to the upper container 10' where it can be seen more clearly, the second support 22' includes a tapered surface 72' that engages a tapered surface 74' of the first support 20' such that the second support 42' cannot be pivoted to the stack position without also pivoting the first support 20' to the stack position. Similarly, the second support 22' includes a tab 76' that is engaged by the third support 24', such that the third support 24' cannot be pivoted to the stack position without also pivoting the second support 22' (and therefore the first support 20') to the stack position.

Figure 5:
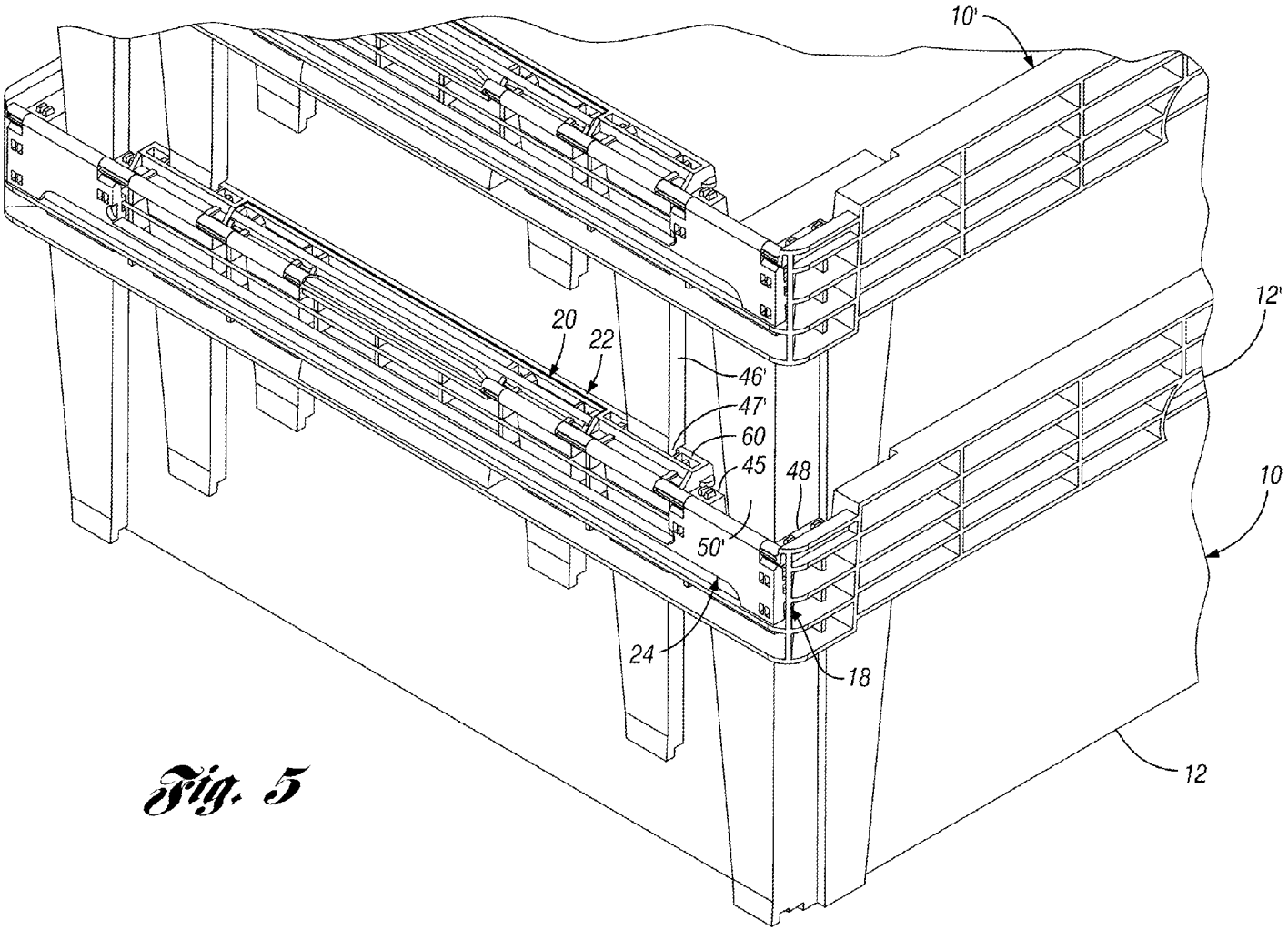
FIG. 5 illustrates the containers of FIG. 3 in a second stacked position.

In FIG. 5, the second supports 22, 22' and the first supports 20, 20' are pivoted to the stack position. The flap 60 of the second support 22 of the lower container 10 covers and blocks the second channel 44 thereby preventing the second projection 46' of the upper container 10' from entering the second channel 44 (FIG. 1). The flap 60 of the second support 22 is supported on the first column 41 (FIG. 1) and the second column 45. The interlocking member 47' of the second projection 46' of the upper container 10' is received within a recess of the flap 60 of the second support 22 of the lower container 10. The third projection 50' of the upper container 10' is partially received within the third channel 48 of the lower container 10. The base 12' of the upper container 10' is supported at a second height above the base 12 of the lower container 10, the second height is greater than the first height.

Figure 6:
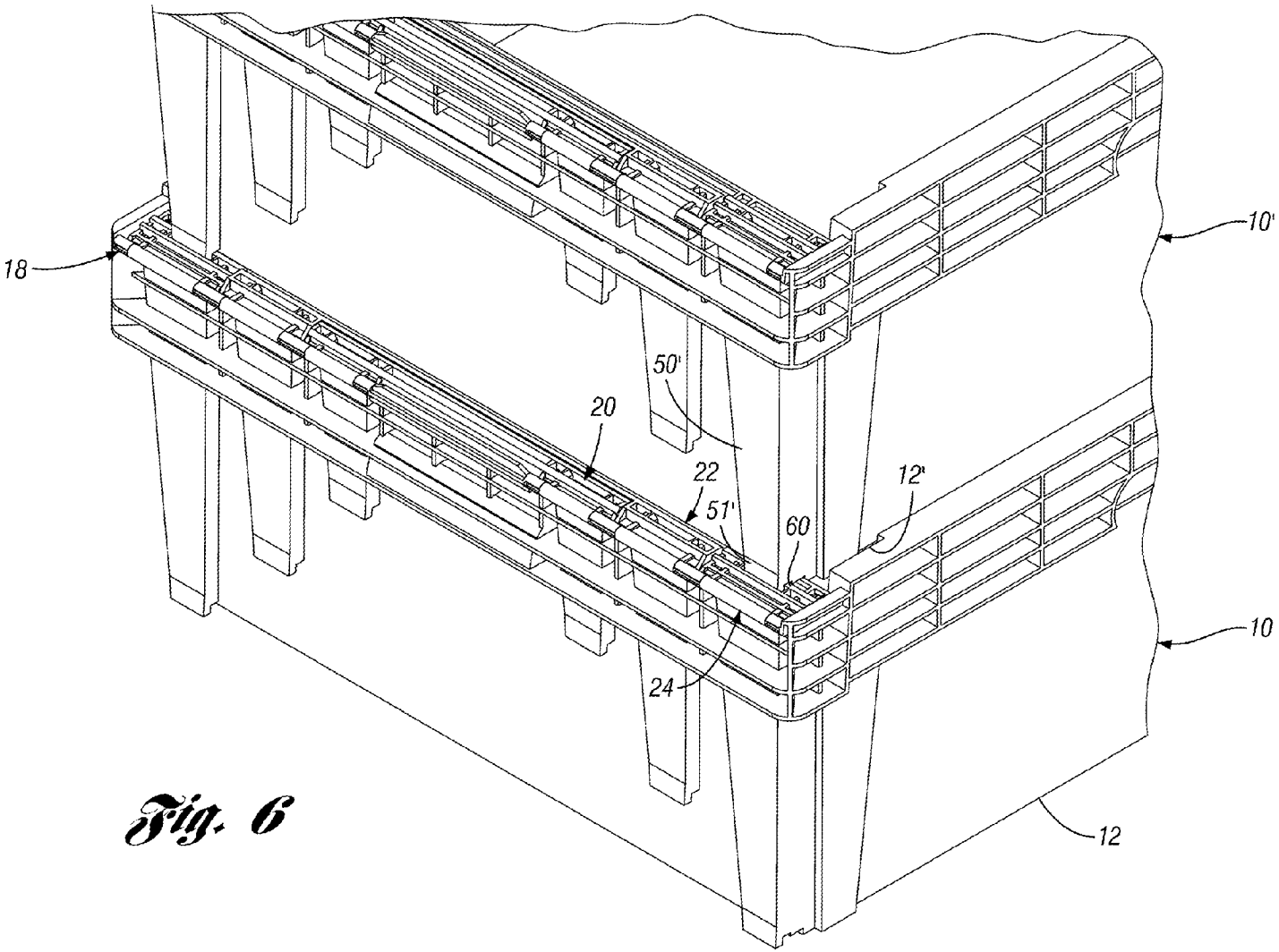
FIG. 6 illustrates the containers of FIG. 3 in a third stacked position.

FIG. 6 illustrates the support systems 18, 18' in the third stacking position, with the first, second and third supports 20, 20', 22, 22', 24, 24' in the stack position. In this position, the flap 60 of the third support 24 of the lower container 10 covers and blocks the third channel 48 (FIG. 1) and is supported on the second and third columns 45, 49 (FIG. 1). The interlocking member 51' of the third projection 50' of the upper container 10' is received in a recess of the flap 60. In this position, the base 12' of the upper container 10' is supported at a third, maximum distance above the base 12 of the lower container 10. This provides the maximum storage container in the lower container 10 with the upper container 10' stacked on it.

Figure 7:
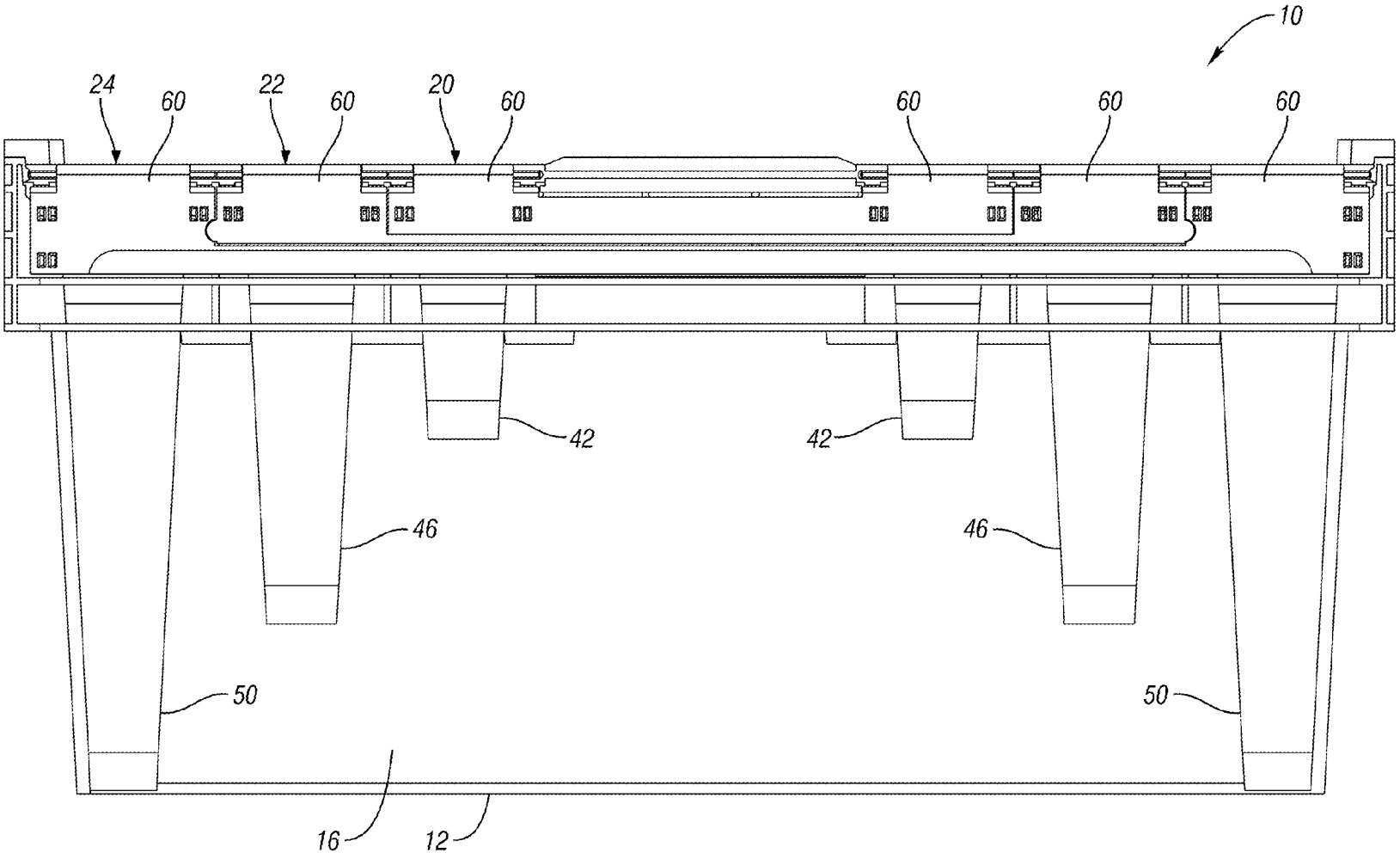
FIG. 7 is an end view of the storage container of FIG. 1.

FIG. 7 is an end view of the storage container 10. As shown, the pair of first projections 42 on end wall 16 are at the same height from the base 12 and are laterally aligned with the flaps 60 of the first support 20. The pair of second projections 46 are at equal heights from the base 12, both lower than the first projections 42, and are laterally aligned with the flaps 60 on the second support 22. The pair of second projections 46 are laterally outward of the first projections 42. The pair of third projections 50 are at equal heights from the base 12, both lower than the second projections 46, and are laterally aligned with the flaps 60 on the third support 24. The pair of third projections 50 are laterally outward of the second projections 46.

Figure 8:
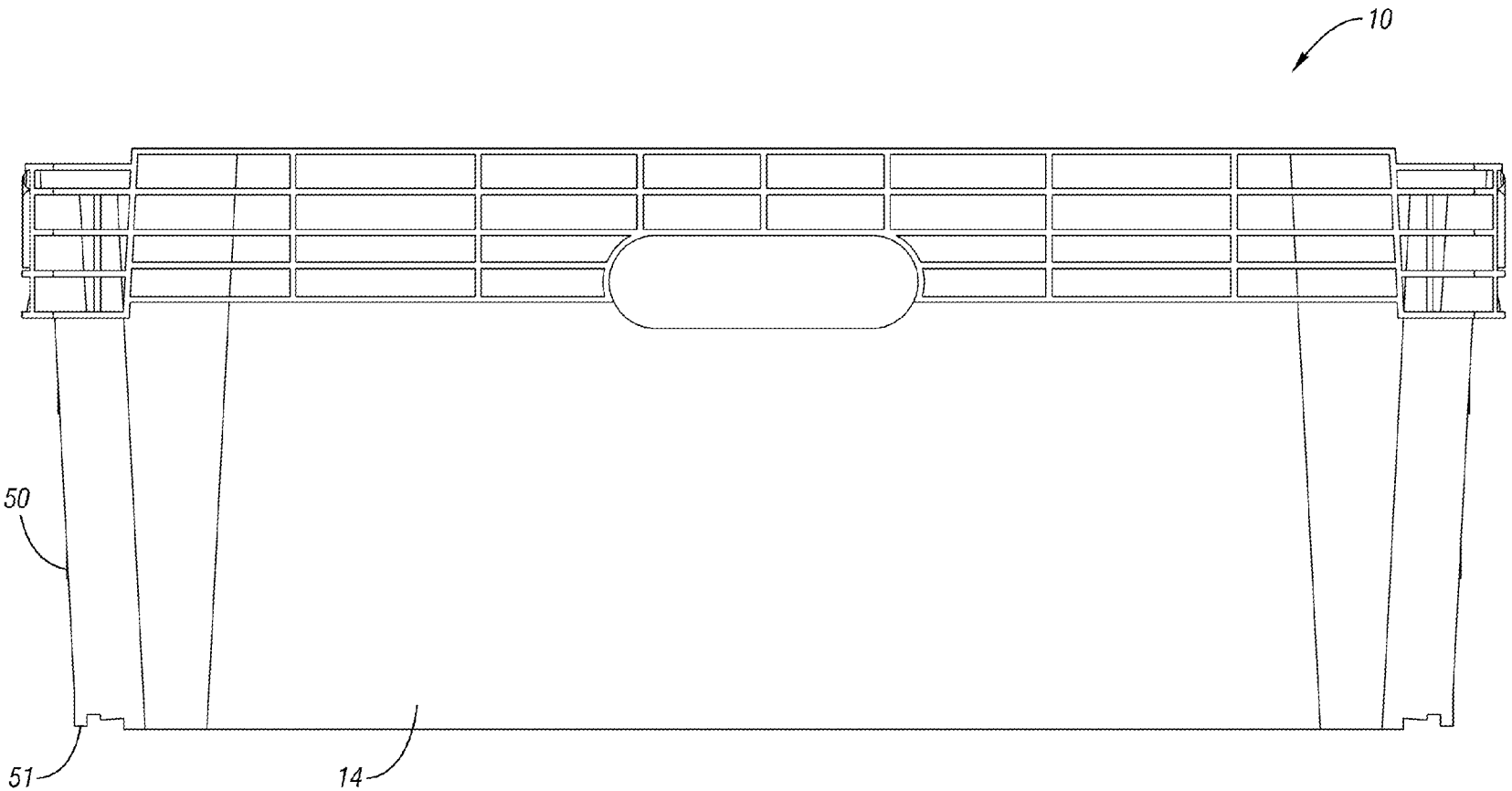
FIG. 8 is a side view of the storage container of FIG. 1.

FIG. 8 is a side view of the storage container 10. The third projections 50 and the interlocking member 51 are shown.

Figure 9:
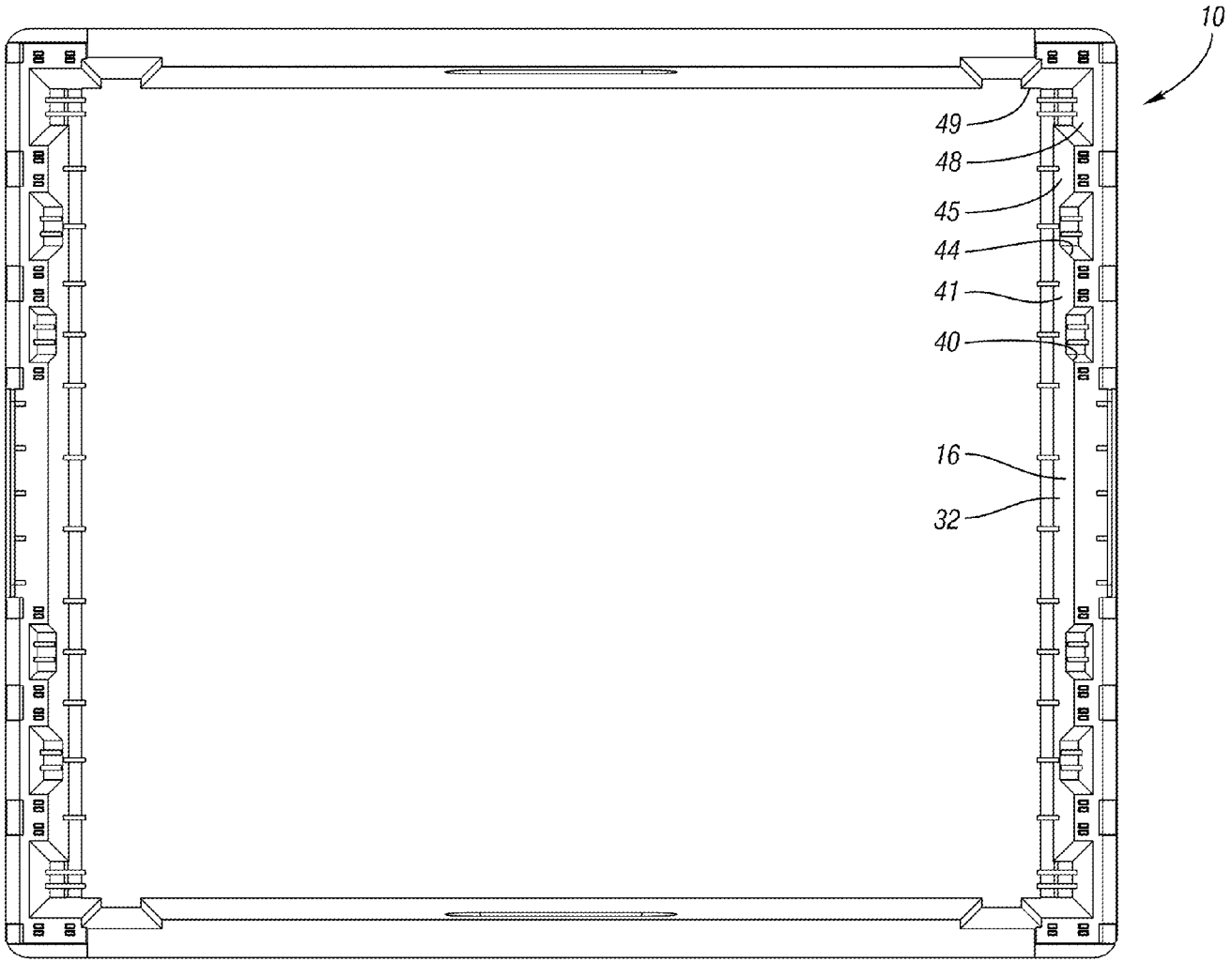
FIG. 9 is a top view of the storage container of FIG. 1.
Figure 10:
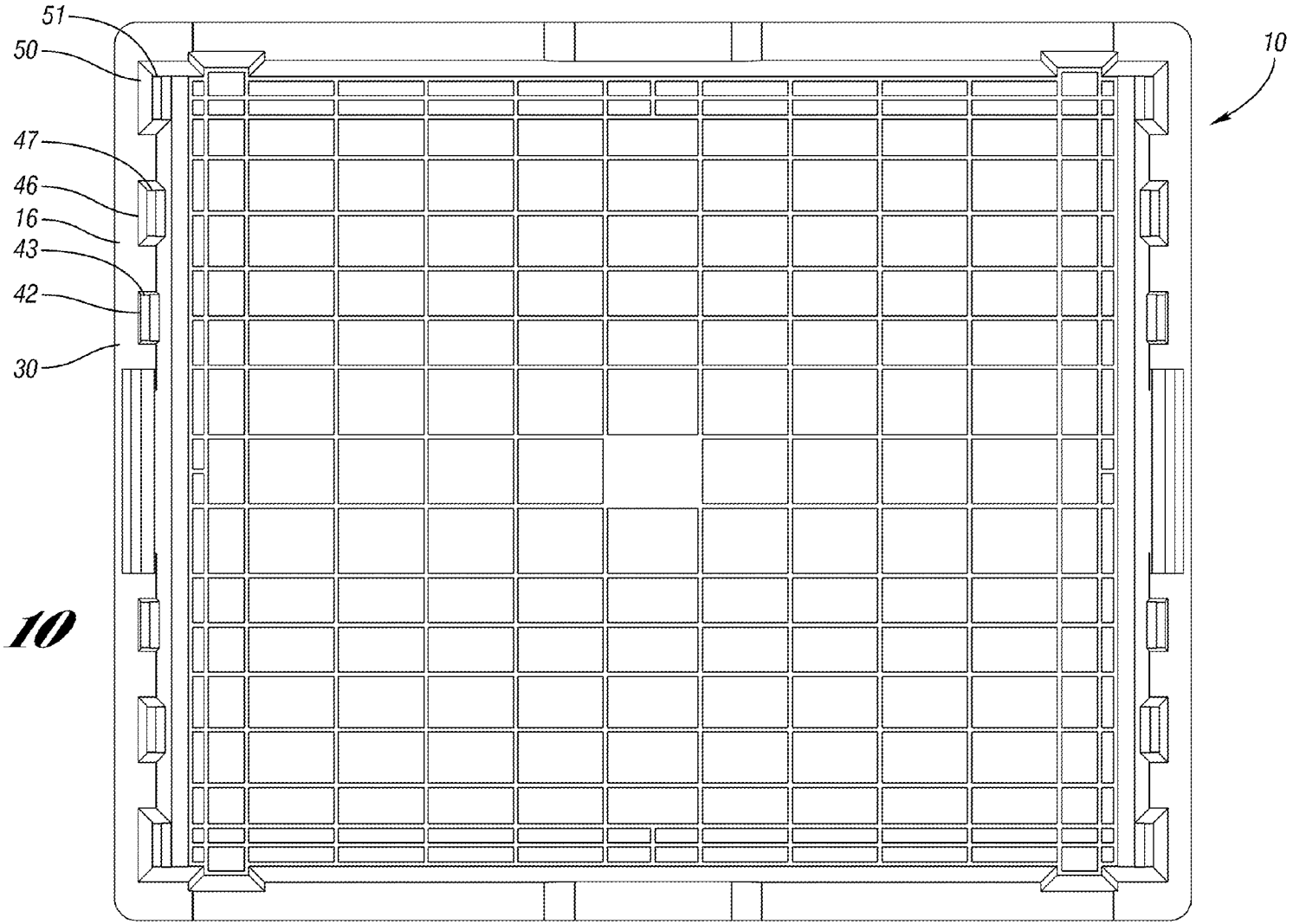
FIG. 10 is a bottom view of the storage container of FIG. 1.

FIG. 9 is a top view of the storage container 10, illustrating the columns 41, 45, 49 and the channels 40, 44, 48 formed on the interior 32 of the end walls 16. FIG. 10 is a bottom view of the storage container 10, illustrating the projections 42, 46, 50 and interlocking members 43, 47, 51 formed on the exterior 30 of the end walls 16.

Figure 11:
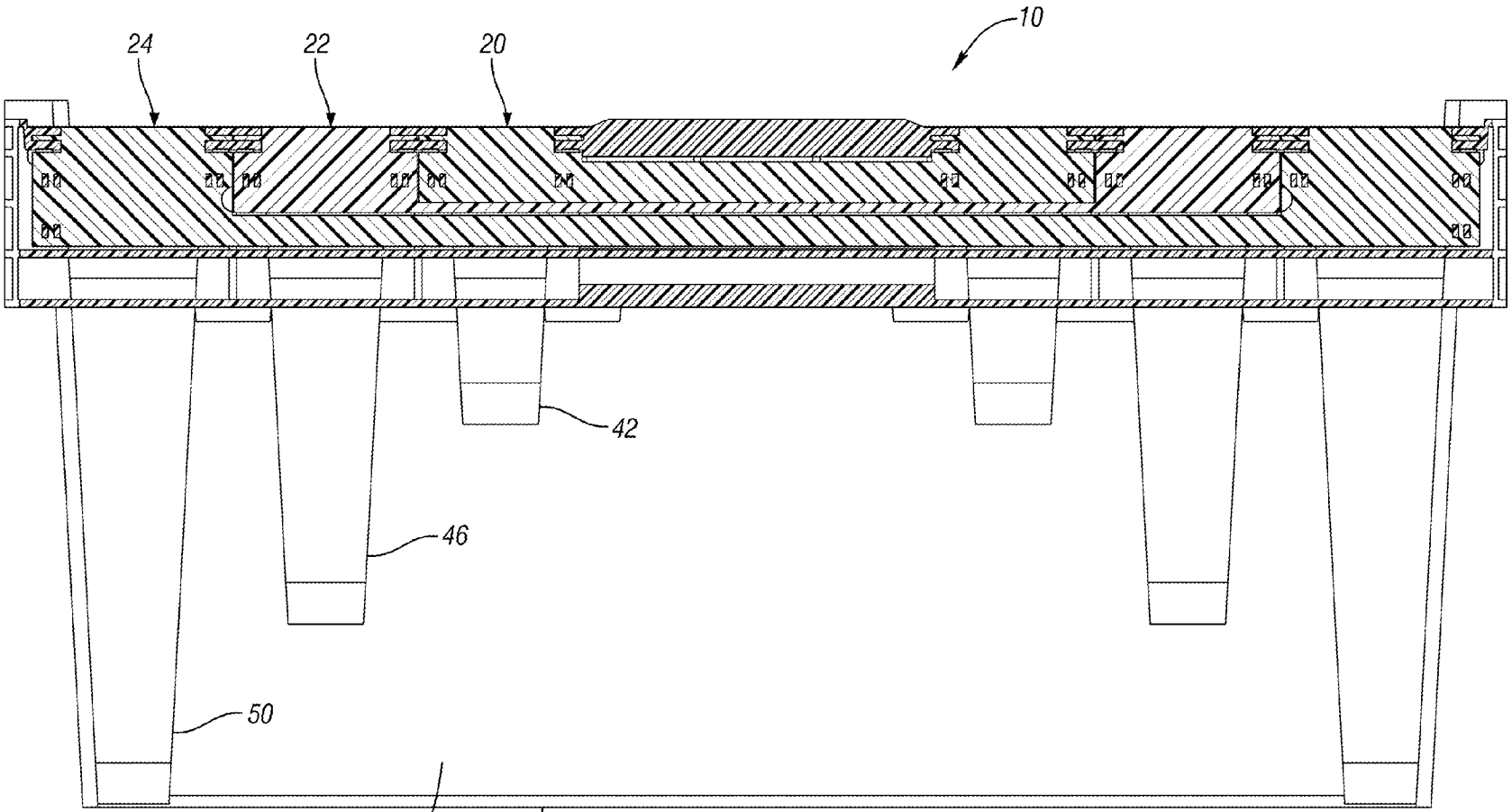
FIG. 11 is an end view of the storage container of FIG. 1 indicating one possible color scheme.

FIG. 11 is an end view of the storage container 10, with shading to indicate one potential useful color scheme. As shown, the first support 20 is preferably a first color as are the first projections 42. The second support 22 and the second projections 46 are a second color. The third support 24 and the third projections 50 are a third color. The end wall 16 (and the rest of the container 10) are preferably a fourth color. In this manner, it is easier for a user to select one of the supports 20, 22, 24 by clearly recognizing the corresponding projection 42, 46, 50. The supports 20, 22, 24 are molded separately from the end wall 16, and thus may be molded of a plastic of the appropriate color. The projections 42 may be painted, covered with stickers or molded of a plastic of the appropriate color using a multi-shot mold.

Figure 14:
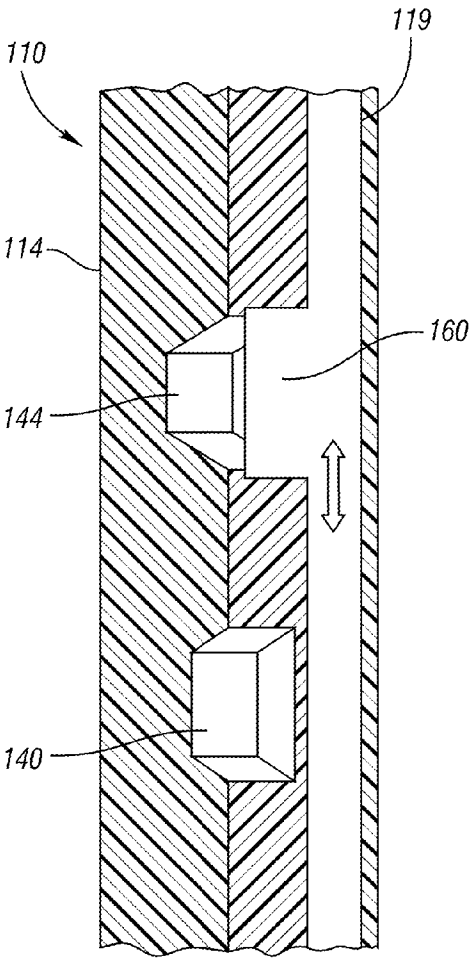
FIG. 14 illustrates the end wall of FIG. 12 with the support in a second support position.
Figure 13:
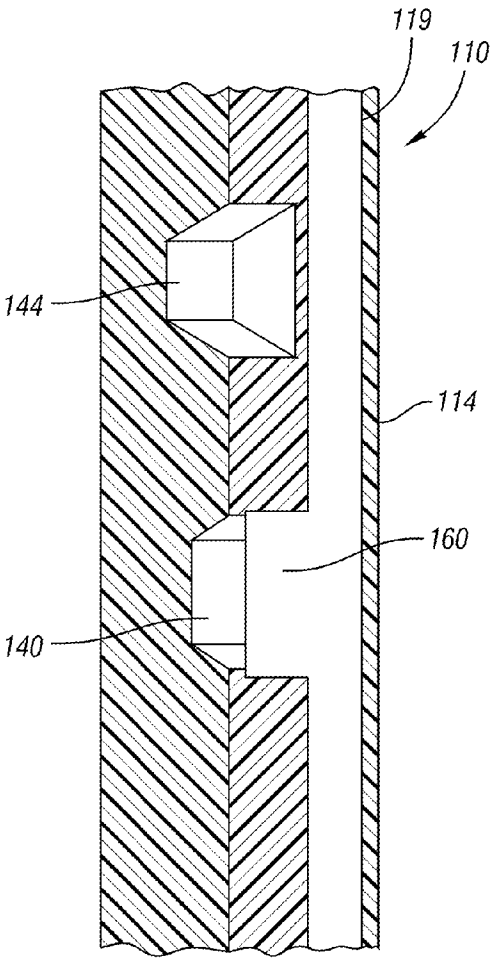
FIG. 13 illustrates the end wall of FIG. 12 with the support in a first support position.
Figure 12:
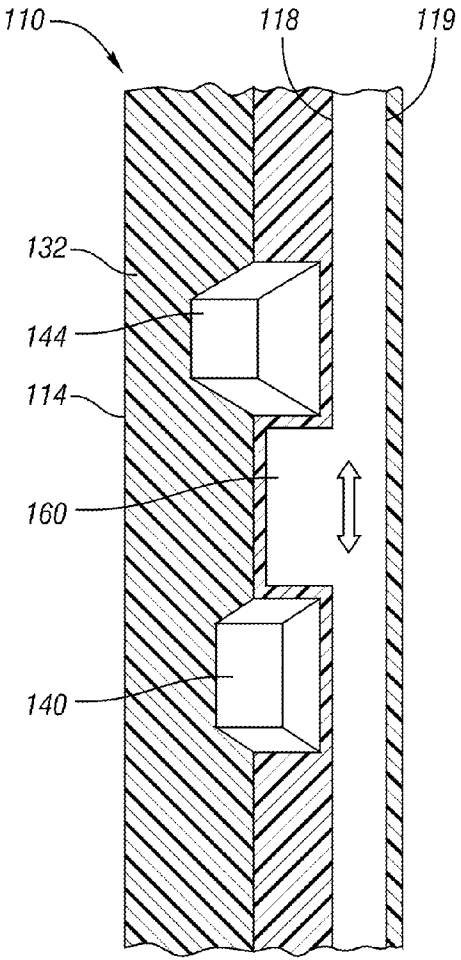
FIG. 12 is a top view of a portion of a end wall and support on a storage container according to a second embodiment of the present invention.

An end wall 114 of a storage container 110 according to a second embodiment is shown in FIGS. 12-14. FIGS. 12-14 are top views of an end wall 114 that could be used in place of the end walls 14 in the storage container 10 of FIGS. 1-11. Except as otherwise described, the storage container 110 could be identical to the storage container 10 of the first embodiment except as otherwise described or shown below. The end wall 114 includes a first channel 140 and a second channel 144 on an interior surface 132. The support system 118 includes a support 119 that is slideable along the upper surface of the end wall 114, such that a support surface or flap 60 can selectively cover and block neither of the channels 140, 144, the first channel 140 (FIG. 13) or the second channel 144 (FIG. 14). Additional channels (such as a third channel, like the first embodiment) could be added. Like the first embodiment, the end wall 114 of the storage container 110 includes a pair of first channels 140 (one shown) and a pair of second channels 144 (one shown) and the support 119 includes a pair of flaps 160 for covering the pairs.

In the description above and in the claims, the term "projection," such as the first, second and third projections 42, 46, 50, means any surface that protrudes laterally, or in a plane parallel to the base 12, relative to a surface above or below it vertically (i.e. perpendicular to the base 12). This is demonstrated by a third embodiment shown in FIGS. 15-16.

Figure 15:
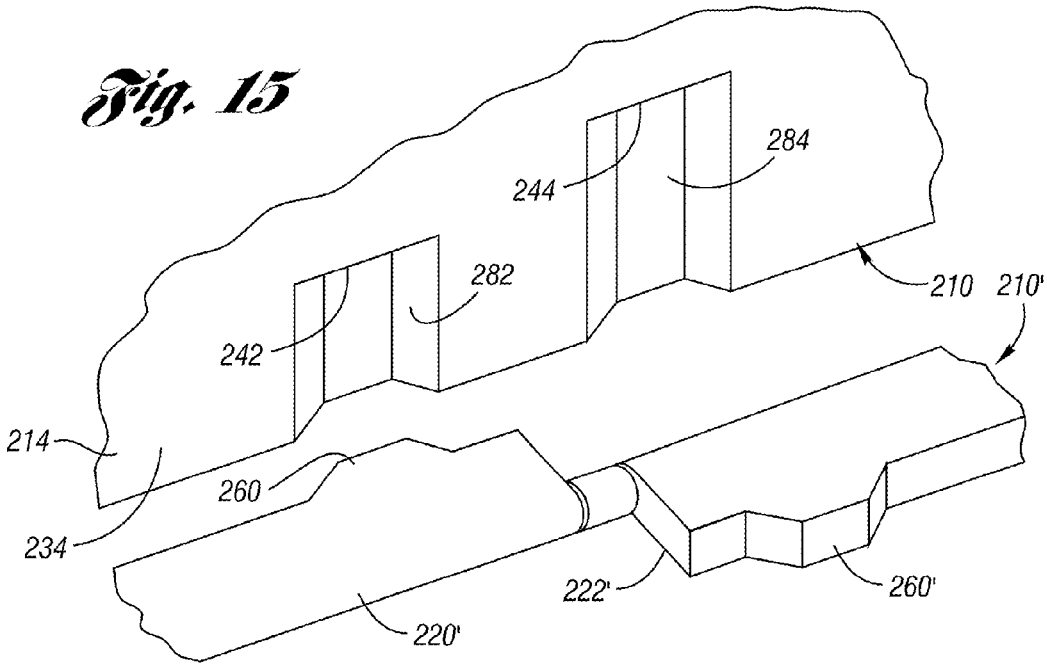
FIG. 15 is a perspective view of a portion of an upper container and a lower container according to a third embodiment of the present invention.

FIG. 15 illustrates a lower container 210' and an upper container 210. The upper container includes a first projection 242 defined by a first recess 282 therebelow formed in the exterior surface 234 of the end wall 214. Similarly, a second projection 242 is defined by a second recess 284 therebelow.

Figure 16:
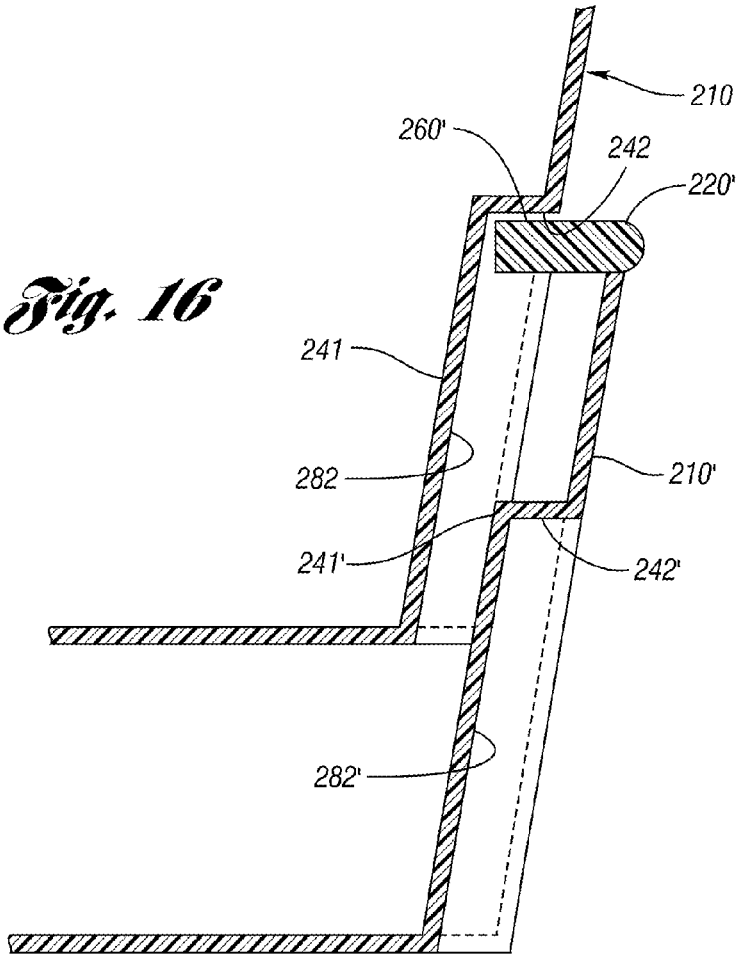
FIG. 16 is a sectional view through the end walls of the containers of FIG. 15, with the supports in a first support position.

By selectively pivoting a first support 220' of the lower container 210' inwardly, the first projection 242 of the upper container 210 can be supported at a first height by the first support 220' of the lower container 210', as shown in FIG. 16. The first recess 282 forms a corresponding first column 241 on a interior surface 232 of the storage container 210.

Similarly, (although not illustrated) by selectively pivoting a second support 222' of the lower container 210' inwardly, the second projection 244 of the upper container 210 can be supported at a second height by the second support 222' of the lower container 210'. Additional supports and projections could be used to provide different support heights, as in the first embodiment.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A storage container comprising:

a generally horizontal base;

a plurality of walls extending upwardly from the base, the plurality of walls including a first wall;

a first support pivotably connected to the container proximate an upper edge of the first wall and pivotable between a support position and an open position, the first support including a first support surface; and a second support pivotable relative to the container and relative to the first support between a support position and an open position, the second support proximate the upper edge of the first wall, the second support including a second support surface;

wherein an identical container can be nested within the plurality of walls of the container when the first support and the second support are in the open position, and wherein the identical container would contact the first support at a first height above the base when the first support is in the support position, and wherein the identical container would contact the second support at a second height above the base when the second support is in the support position, the first height different from the second height; and wherein the first wall is at one end of a first half of the container, the first support and the second support disposed completely in the first half of the container.

2. The storage container of claim 1 wherein the second support surface is offset laterally from the first support surface in a direction parallel to the base.

3. The storage container of claim 2 further including a first projection, the first projection being vertically aligned with the first support surface when the first support is pivoted to the support position and not vertically aligned with the first support surface when the first support is pivoted to the open position.

4. The storage container of claim 3 further including a second projection, the second projection being vertically aligned with the second support surface when the second support is pivoted to the support position and not vertically aligned with the second support surface when the second support is pivoted to the open position.

5. The storage container of claim 4 wherein the first support is pivotably connected to the first wall, the first projection extending outwardly from an exterior of the first wall.

6. The storage container of claim 4 wherein the first support and the first projection are a first color and wherein the second support and the second projection are a second color different from the first color.

7. The storage container of claim 5 wherein the second support is pivotably connected to the first wall, the second projection extending outwardly from an exterior of the first wall.

8. The storage container of claim 7 wherein the first projection is at a height above the base different from a height above the base of the second projection.

9. The storage container of claim 1 wherein the first support and the second support are each pivotably connected to the first wall.

10. The storage container of claim 1 wherein the first support and the second support are each pivotable about the same axis.

11. The storage container of claim 1 wherein the first support is pivotable about a first axis not inward of the first wall and the second support is pivotable about a second axis not inward of the first wall.

12. The storage container of claim 1 wherein the first support and the second support are vertically aligned completely outward of the base when the first support and the second support are pivoted to inward positions.

13. The storage container of claim 1 wherein at least a portion of the first support is a first color and at least a portion of the second support is a second color different from the first color.

14. The storage container of claim 1 wherein the plurality of walls includes a second wall opposite the first wall, the container further including:

a third support pivotably connected to the container proximate an upper edge of the second wall and pivotable between a support position and an open position, the third support including a third support surface; and a fourth support pivotable relative to the container and relative to the third support between a support position and an open position, the fourth support proximate the upper edge of the second wall, the fourth support including a fourth support surface;

wherein the identical container can be nested within the plurality of walls of the container when the third support and the fourth support are in the open position, and wherein the identical container would contact the third support at the first height above the base when the third support is in the support position, and wherein the identical container would contact the fourth support at the second height above the base when the fourth support is in the support position.

15. A storage container comprising:

a generally horizontal base;

a plurality of walls extending upwardly from the base, the plurality of walls including a first wall;

a first support pivotably connected to the container proximate an upper edge of the first wall and pivotable between a support position and an open position, the first support including a first support surface; and a second support pivotable relative to the container and relative to the first support between a support position and an open position, the second support proximate the upper edge of the first wall, the second support including a second support surface;

wherein an identical container can be nested within the plurality of walls of the container when the first support and the second support are in the open position, and wherein the identical container would contact the first support at a first height above the base when the first support is in the support position, and wherein the identical container would contact the second support at a second height above the base when the second support is in the support position, the first height different from the second height; and further including a third support pivotable relative the first support and the second support, the third support having a third support surface offset laterally from the first support surface and the second support surface when the first, second and third supports are in the support position.

16. A storage container comprising:

a generally horizontal base;

a plurality of walls extending upwardly from the base, the plurality of walls including a first wall;

a first support pivotably connected to the container proximate an upper edge of the first wall and pivotable between a support position and an open position, the first support including a first support surface; and a second support pivotable relative to the container and relative to the first support between a support position and an open position, the second support proximate the upper edge of the first wall, the second support including a second support surface;

wherein an identical container can be nested within the plurality of walls of the container when the first support and the second support are in the open position, and wherein the identical container would contact the first support at a first height above the base when the first support is in the support position, and wherein the identical container would contact the second support at a second height above the base when the second support is in the support position, the first height different from the second height; and wherein the plurality of walls includes a second wall opposite the first wall, wherein the first support and the second support comprise a first support system, and wherein the second wall includes a second support system like the first support system.

17. A storage container comprising:

a base;

a plurality of walls extending upwardly from the base, the plurality of walls including a first wall having a first projection and a second projection; and a support system reconfigurable between an open configuration, a first support configuration and a second support configuration, such that the first projection of an identical container stacked on the storage container would contact the support system to support the identical container at a first height above the base when the support system is in the first support configuration, and such that the second projection of the identical container stacked on the storage container would contact the support system to support the identical container at a second height above the base when the support system is in the second support configuration, the second height different from the first height; and wherein the first projection is vertically offset from the second projection.

18. The storage container of claim 17 wherein the first projection and the second projection form corresponding first and second channels on an interior of the container, such that the first projection and the second projection of the identical container stacked on the storage container are received in the first and second channels, respectively, of the storage container when the support system is in the open configuration.

19. The storage container of claim 18 wherein the support system selectively blocks the first channel but not the second channel in the first support configuration and blocks the second channel in the second support configuration.

20. The storage container of claim 19 wherein the support system includes a first support proximate the first wall that blocks the first channel in the first support configuration and a second support proximate the first wall that blocks the second channel in the second support configuration, the first support pivotable relative to the second support.

21. The storage container of claim 20 wherein the first projection is laterally offset from the second projection in a direction parallel to the first wall.

22. The storage container of claim 17 wherein the support system includes a plurality of supports proximate an upper edge of the first wall, each pivotable relative to the container between an open position and a support position.

23. The storage container of claim 17 wherein the support system includes a support, the support movable relative to the walls to a position vertically aligned with the first projection when the support system is in the first support configuration.

24. The storage container of claim 23 wherein the support is movable to a position vertically aligned with the second projection when the support system is in the second support configuration.

25. The container of claim 17 wherein a base of the identical container would be parallel to the base of the storage container when the identical container is stacked on the storage container and the support system is in the first support configuration and when the identical container is stacked on the storage container and the support system is in the second support configuration.

26. A storage container comprising:

a base;

a plurality of walls extending upwardly from the base, the plurality of walls including a first wall having a first projection and a second projection; and a support system reconfigurable between an open configuration, a first support configuration and a second support configuration, such that the first projection of a like container stacked on the storage container would contact the support system to support the like container at a first height above the base when the support system is in the first support configuration, and such that the second projection of a like container stacked on the storage container would contact the support system to support the like container at a second height above the base when the support system is in the second support configuration, the second height different from the first height;

wherein the support system includes a plurality of supports proximate an upper edge of the first wall, each pivotable relative to the container between an open position and a support position, wherein the plurality of supports are all pivotable about the same axis.

27. A storage container comprising:

a base;

a plurality of walls extending upwardly from the base, the plurality of walls including a first wall having a first projection and a second projection, the plurality of walls further including a first channel and a second channel formed on a surface of the first wall of the container, the first projection vertically aligned with the first channel, the second projection vertically aligned with the second channel; and a support system proximate the first wall, the support system reconfigurable between an open configuration, a first support configuration and a second support configuration, such that the first channel is blocked from receiving the first projection of an identical container stacked thereon in the first support configuration, the second channel not being blocked from receiving the first projection of the identical container stacked thereon in the first support configuration, and such that the second channel is blocked from receiving the second projection of the identical container stacked thereon in the second support configuration, wherein the base of the identical container would be supported parallel to and at a first height above the base of the container in the first support configuration, and wherein the base of the identical container would be supported parallel to and at a second height above the base of the container in the second support configuration, the second height different from the first height.

28. The storage container of claim 27 wherein the surface is an exterior of the container.

29. The storage container of claim 27 wherein the surface is an interior of the container.

30. The storage container of claim 27 wherein the first projection of the identical container can be received within the first channel when the support system is in the open configuration.

31. The storage container of claim 27 wherein the plurality of walls further include a third projection vertically aligned with a third channel, the support system further reconfigurable to a third support configuration in which the third channel is blocked from receiving the third projection of the identical container stacked thereon.

32. The storage container of claim 27 wherein the support system includes a support, the support movable relative to the walls to a position blocking the first channel when the support system is in the first support configuration.

33. The storage container of claim 32 wherein the support is movable to a position blocking the second channel when the support system is in the second support configuration.

34. A storage system comprising:

first and second containers each including a base and a plurality of walls;

the plurality of walls extending upwardly from the base, the plurality of walls including a first wall having a first projection and a second projection, the plurality of walls further including a first channel and a second channel formed on a surface of first wall of the container, the first projection vertically aligned with the first channel, the second projection vertically aligned with the second channel; and the first container including a support system proximate the first wall, the support system reconfigurable between an open configuration, a first support configuration and a second support configuration, such that the first channel of the first container is blocked from receiving the first projection of the second container stacked thereon in the first support configuration, and such that the second channel of the first container is blocked from receiving the second projection of the second container stacked thereon in the second support configuration, wherein the base of the second container is supported parallel to and at a first height above the base of the first container in the first support configuration, and wherein the base of the second container is supported parallel to and at a second height above the base of the first container in the second support configuration, the second height different from the first height;

wherein the second projection of the second container can be received within the second channel of the first container when the support system is in the first stack configuration.

* * * * *